US007479612B2

(12) United States Patent
Waldi et al.

(10) Patent No.: US 7,479,612 B2
(45) Date of Patent: Jan. 20, 2009

(54) SPINDLE DRIVE FOR A SWITCH DISCONNECTOR AND/OR GROUNDING SWITCH

(75) Inventors: Wolfgang Waldi, Nussloch-Maisbach (DE); Kuno Hug, Heidelberg (DE); Thomas Betz, Langenselbold (DE); Volker Thomas, Hanau (DE); Henrich Neumaier, Hausach (DE); Peter Klonecki, Frankfurt (DE); Christian Ries, Münster (DE)

(73) Assignee: ABB Technology AG, Zurich (DE)

( * ) Notice: Subject to any disclaimer, the term of this patent is extended or adjusted under 35 U.S.C. 154(b) by 0 days.

(21) Appl. No.: 10/574,099

(22) PCT Filed: Nov. 17, 2004

(86) PCT No.: PCT/EP2004/013003

§ 371 (c)(1),
(2), (4) Date: May 10, 2007

(87) PCT Pub. No.: WO2005/050685

PCT Pub. Date: Jun. 2, 2005

(65) Prior Publication Data

US 2007/0278080 A1 Dec. 6, 2007

(30) Foreign Application Priority Data

Nov. 21, 2003 (DE) ..... 103 54 595

(51) Int. Cl.
*H01H 3/40* (2006.01)

(52) U.S. Cl. ..... 200/507; 218/120; 218/153; 218/154

(58) Field of Classification Search ..... 200/507; 218/119, 120, 152, 153, 155
See application file for complete search history.

(56) References Cited

U.S. PATENT DOCUMENTS

| | | | | |
|---|---|---|---|---|
| 3,198,908 | A | 8/1965 | Staak | |
| 3,787,649 | A * | 1/1974 | Goodwin et al. | 200/400 |
| 3,883,709 | A * | 5/1975 | Cole | 218/119 |
| 3,894,204 | A * | 7/1975 | May et al. | 200/50.23 |
| 4,216,359 | A * | 8/1980 | Hruda | 218/118 |
| 4,225,761 | A * | 9/1980 | Barkan et al. | 218/120 |
| 4,225,763 | A * | 9/1980 | Barkan | 218/120 |
| 4,876,417 | A | 10/1989 | Niederhuefner et al. | |
| 5,107,081 | A * | 4/1992 | Aoyama et al. | 218/84 |
| 5,530,414 | A | 6/1996 | Reynolds | |
| 5,594,223 | A * | 1/1997 | Fukushi et al. | 218/120 |
| 6,624,374 | B2 * | 9/2003 | Koyama et al. | 218/154 |
| 7,236,071 | B2 * | 6/2007 | Prestini et al. | 335/177 |

FOREIGN PATENT DOCUMENTS

| | | |
|---|---|---|
| DE | 8126417 | 3/1985 |
| DE | 36 08 481 A1 | 9/1987 |

(Continued)

*Primary Examiner*—Ramon M Barrera
(74) *Attorney, Agent, or Firm*—Buchanan Ingersoll & Rooney PC

(57) ABSTRACT

A circuit breaker and/or earthing switch are disclosed wherein a rotatable spindle nut, which is mounted in a spindle housing, displaces a spindle in a translatory manner, thus displacing contact elements of the switching device. The spindle actuates a contact pin that is configured in a contact carrier by a connection yoke that is common to all phases or poles and an isolating bar for each phase or pole.

9 Claims, 4 Drawing Sheets

FOREIGN PATENT DOCUMENTS

| | | |
|---|---|---|
| DE | 3802394 | 8/1989 |
| DE | 4142548 | 6/1993 |
| DE | 19534392 | 3/1997 |
| DE | 19632574 | 2/1998 |
| DE | 60003827 | 5/2004 |

* cited by examiner

SPINDLE DRIVE FOR A SWITCH DISCONNECTOR AND/OR GROUNDING SWITCH

The invention relates to a spindle drive for a switch disconnector and/or a grounding switch as claimed in the precharacterizing clause of claim 1. By way of example, the invention may be used for combined high-voltage switch disconnectors and grounding switches.

DE 36 08 481 A1 discloses a drive apparatus for an electrical switch disconnector, which has a spindle which is mounted such that it can rotate and is coupled for drive purposes to the moving contact piece of the switch disconnector, such that the moving contact piece is operated on rotation of the spindle. A gearwheel is fitted to the spindle and engages with a toothed drive, which is coupled to an electric-motor drive, in order to rotate it and thus to operate the moving contact piece. In addition, the spindle can also be rotated by a hand crank. In order to simplify this manual operation and in order to ensure the coupling of the gearwheel to the toothed drive when the hand crank is pulled, the gearwheel can be moved between two positions on the spindle by the hand crank, in which case it engages with the toothed drive in the first position and is free of the toothed drive in the second position. Controllable locking elements are provided between the hand crank and the spindle.

DE 41 42 548 C2 discloses a drive for a switch disconnector having a driveshaft which can be driven by a motor or by hand and acts on the switch, with a gearwheel transmission being provided, which is in the form of a worm-gear transmission and transmits power from the motor to the driveshaft.

DE 195 34 392 AS1 discloses a drive for the moving contact piece of a switch disconnector/grounding switch, in which the contact piece driveshaft is coupled to a drive disk that is provided with two radial slots which form a V-shape. Two drive elements which can be moved parallel to one another and linearly are provided, each engage in one of the slots and pivot the drive disk from a central position to the first and second positions. The drive elements may be formed by roller drives (which are screwed to threaded spindles that are each driven by one motor) with a bolt projection, which in each case engages in the associated slot.

DE 38 02 394 A1 discloses a combined switch disconnector and grounding switch for high voltage, in which a drive apparatus having a threaded spindle, a traveling nut and a motor moves a switching rod, which can be moved in the longitudinal direction, upwards and downwards.

The invention is based on the object of specifying a spindle drive for a switch disconnector and/or grounding switch with an optimized design.

This object is achieved in conjunction with the features of the precharacterizing clause according to the invention, by the features which are specified in the characterizing part of claim 1.

The advantages which can be achieved by the invention are, in particular, that the proposed spindle drive requires no deflection with respect to the movement direction, but carries out a linear adaptation. No transmission is required, thus resulting in high efficiency. The movement is transmitted 1:1. The moving parts can be mounted easily. A single motor is sufficient for the multiple pole (polyphase), for example three-pole, movement of the switching device. The motor can be positioned very accurately via the spindle, with little force. The selected "contact", "grounding", "mid-position" positions can be maintained very easily.

Further advantages will become evident from the following description.

Advantageous refinements of the invention are characterized in the dependent claims.

The invention will be explained in the following text with reference to the exemplary embodiments that are illustrated in the drawing, in which.

Figure 1:
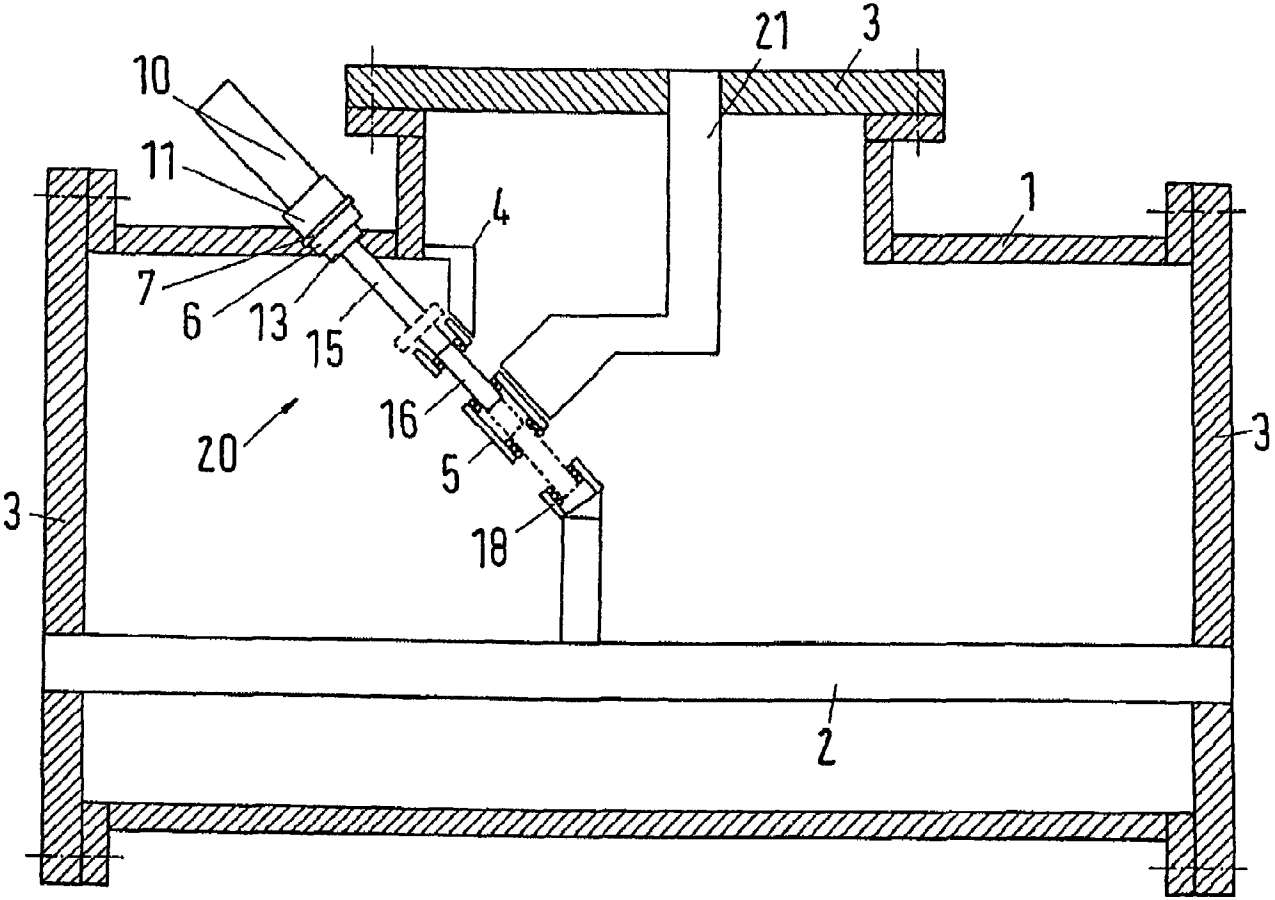
FIG. 1 shows a side view of a switching chamber housing with a spindle drive.

FIG. 1 shows a side view of a switching chamber housing with a spindle drive. This shows a switching chamber housing 1 of a gas-insulated switchgear assembly in whose interior a plurality of busbars 2 run, with a three-pole (three-phase) combined switch disconnector and grounding switch 20 being provided as the switching device. This combined switch disconnector and grounding switch 20 has a central contact mount 5 for each pole (phase), which is in each case electrically connected to an outgoing feeder 21. The switch disconnector and grounding switch 20 furthermore has:

- a grounding switch contact 4 for each pole, which is connected to the housing wall of the switching chamber housing 1, which is at ground potential, and
- a switch disconnector contact 18 for each pole, which is connected to a busbar 2.

By means of contact pins 16 which can move linearly within the contact mount 5, the switch disconnector and grounding switch 20 alternatively allows:

- an electrical connection busbars 2—switch disconnector contacts 18—contact pins 16—contact mount 5—outgoing feeder 21 ("contact" position),
- an electrical connection outgoing feeder 21—contact mount 5—contact pins 16—grounding switch contacts 4—ground potential on the housing wall of the switching chamber housing 1 ("grounding" position),
- isolation between the outgoing feeder 21 and the busbars 2, as well as between the outgoing feeder 21 and the ground potential on the housing wall of the switching chamber housing 1 when the contact pins 16 are in the mid-position within the contact mount 5 ("mid-position" position).

The contact pins 16 are connected to a spindle 10 via an isolation rod 15 for each pole (phase) and a connecting yoke 13 which is shared by all the poles (phases), so that the linear movement, which is desired in order to carry out switching processes, of the contact pins 16 relative to the stationary grounding switch contacts 4 and switch disconnector contacts 18 takes place. The spindle 10 is driven (translational spindle movement) by rotation of a spindle nut 11, which is mounted in a spindle nut housing 6 by means of a bearing 6 such that it can rotate. By way of example, the spindle nut 11 can be rotated using a motor and a pulley belt, or by using at least one gearwheel (in which case the spindle nut 11 is provided with an external toothed rim). A single motor is advantageously sufficient to carry out the three-pole (three-phase) movement of the contact pins 16 of the switch disconnector and grounding switch. A manual drive acting on the spindle 10 is, of course, also provided for the switch disconnector and grounding switch 20.

A plurality of suitable isolating flanges 3 are used in a generally known manner for the busbars 2 and the outgoing feeder 21 to be passed out of the switching chamber housing 1.

Figure 2:
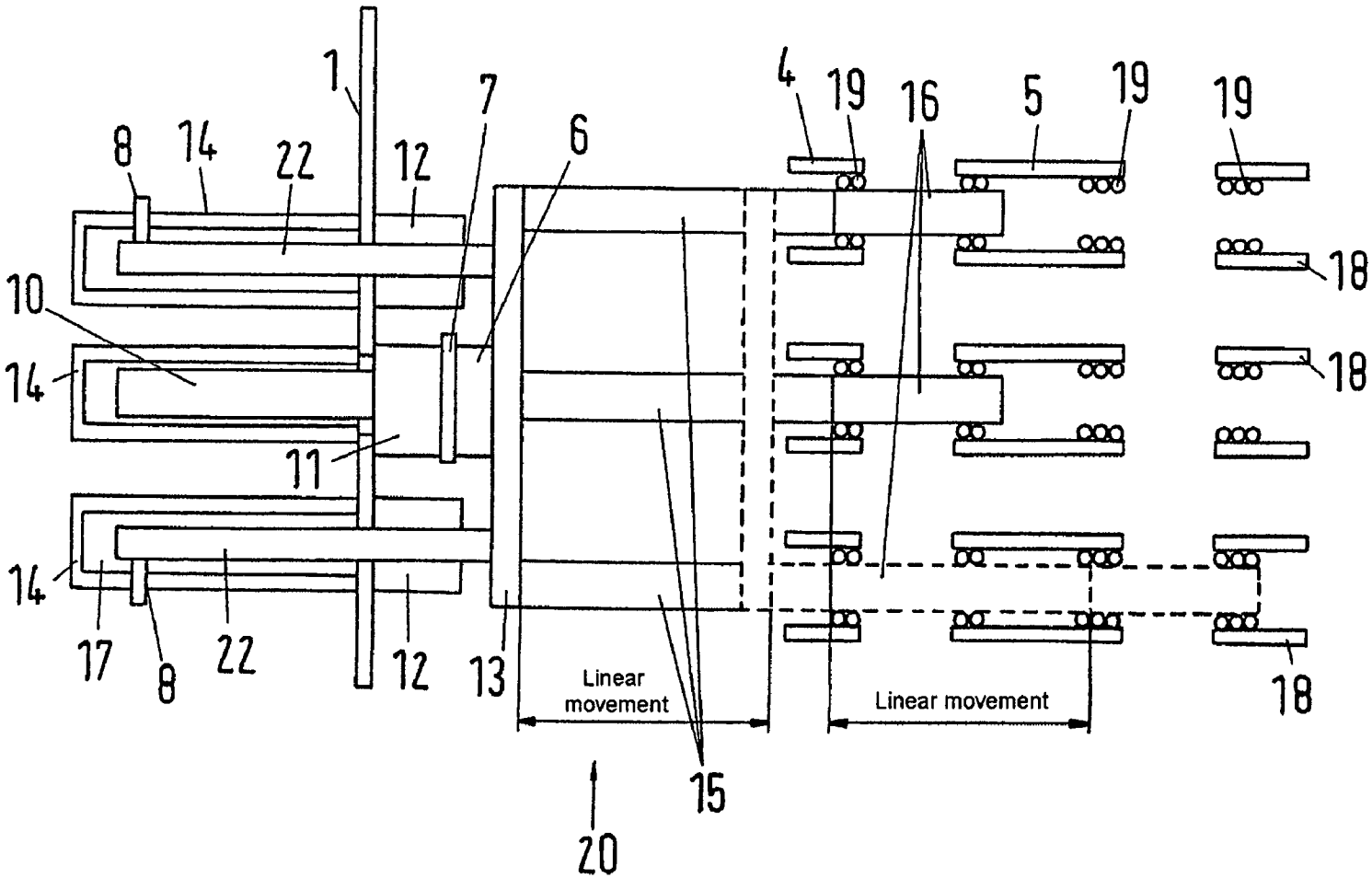
FIG. 2 shows a side section through the spindle drive.

FIG. 2 shows a side section through the spindle drive. This shows a section of a switching chamber housing 1 with the three-pole (three-phase) combined switch disconnector and grounding switch 20. Three contact mounts 5 are used to guide the contact pins 16 and for selectively making contact between these contact pins 16 and the switch disconnector contacts 18 or grounding switch contacts 4. The electrical contact is itself expediently made in each case by means of spiral spring contacts (contact rings) 19 which surround the contact pins 16 closely and in a sprung manner when contact is made.

The contact pins 16 are connected via three isolation rods 15 to a common connecting yoke 13 on which the spindle 10 is mounted together with a guide bolt 22 on each of the two sides of the spindle with both the spindle 10 and the two guide bolts 22 passing through the housing wall of the switching chamber housing 1. As already mentioned above, the spindle, which can be moved translationally, is driven by the use of the spindle nut 11, which can rotate and is mounted in the spindle nut housing 6 using a bearing 7, such that it can rotate.

During the translational movement of the spindle 10, the two guide bolts 22 slide in linear guides 12 which are firmly connected to the housing wall of the switching chamber housing 1. Gas-tight covers 14 in the form of caps grip the outer face of the housing wall of the switching chamber housing 1 via the guide bolts 22 and the spindle 10. Isolating gas 17 is located in the interior of these covers 14, as well as in the interior of the switching chamber housing 1. The linear guides 12 result in the contact pins 16 entering the spiral spring contacts 19 very precisely.

The guide bolts 22, which can move translationally within the covers 14, expediently at the same time result in a sealed position indication 8 for indication of the instantaneous position of the switch disconnector and grounding switch 20.

Figure 3:
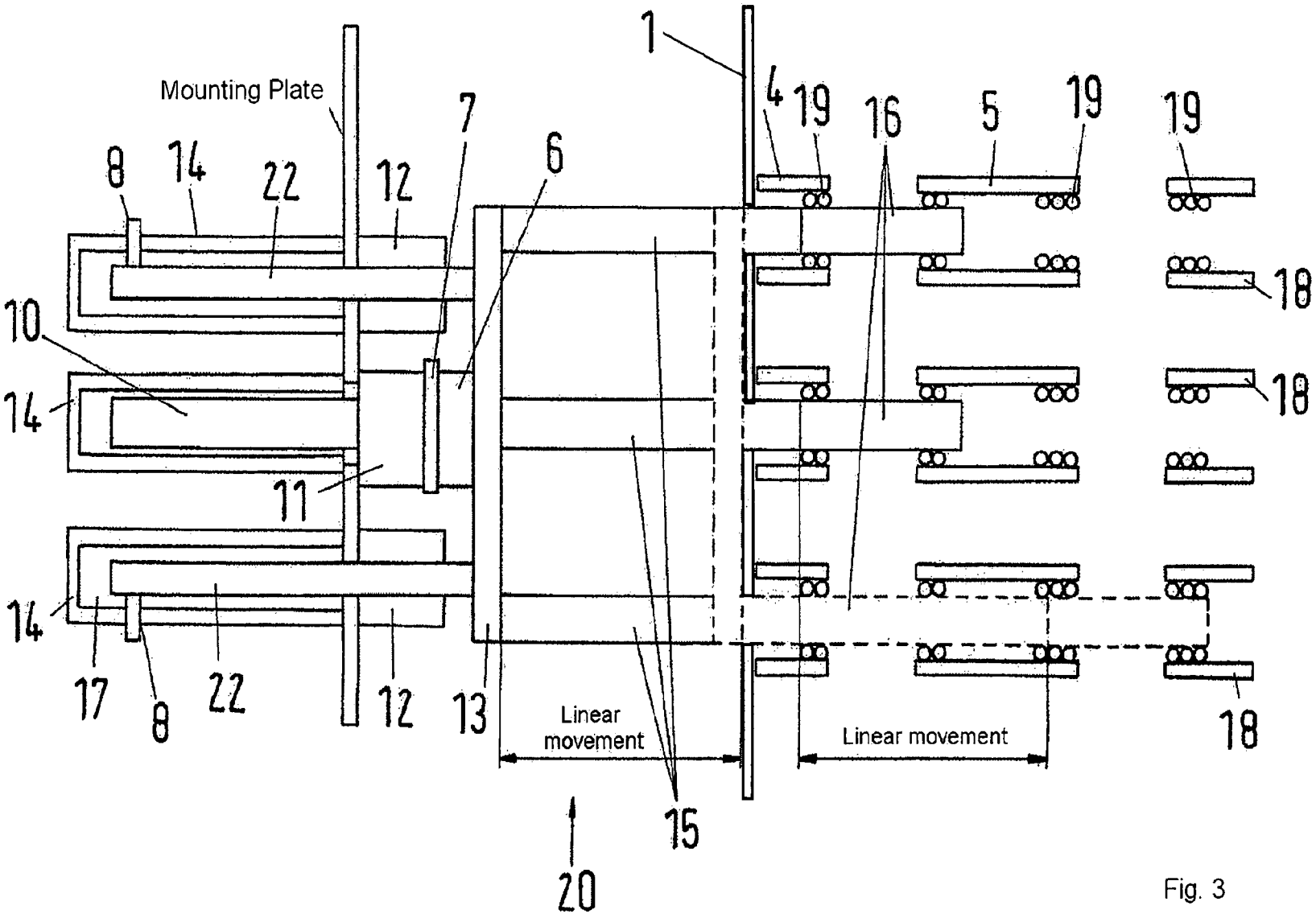
FIG. 3 shows another embodiment of a side section through the spindle drive having isolation rods.

In the embodiment explained above, the spindle and the associated drive components are located in the gas area of the switching chamber housing. As shown in FIG. 3 and according to one alternative embodiment, it is also possible by virtue of the geometric configuration of the spindle drive for the individual phases to be passed out of the switching chamber housing 1 in an isolated form. This is expediently achieved by means of the isolation rods 15, which are passed through the wall of the switching chamber housing 1 through sealed apertures, with the connecting yoke 13, the spindle 10, the spindle nut 11, the spindle nut housing 6, the bearing 7, the guide bolts 22, the linear guide 12 and the position indication 8 being arranged outside the switching chamber housing 1 in this alternative embodiment.

Although the drive is used for a switch disconnector and grounding switch in the exemplary embodiment, it is also possible in the same way to use the drive for a separate switch disconnector or grounding switch. In the same way, the drive is not restricted to a specific number of phases, that is to say the drive is universally suitable for switching devices with two, three, four etc. poles (phases).

Figure 4:
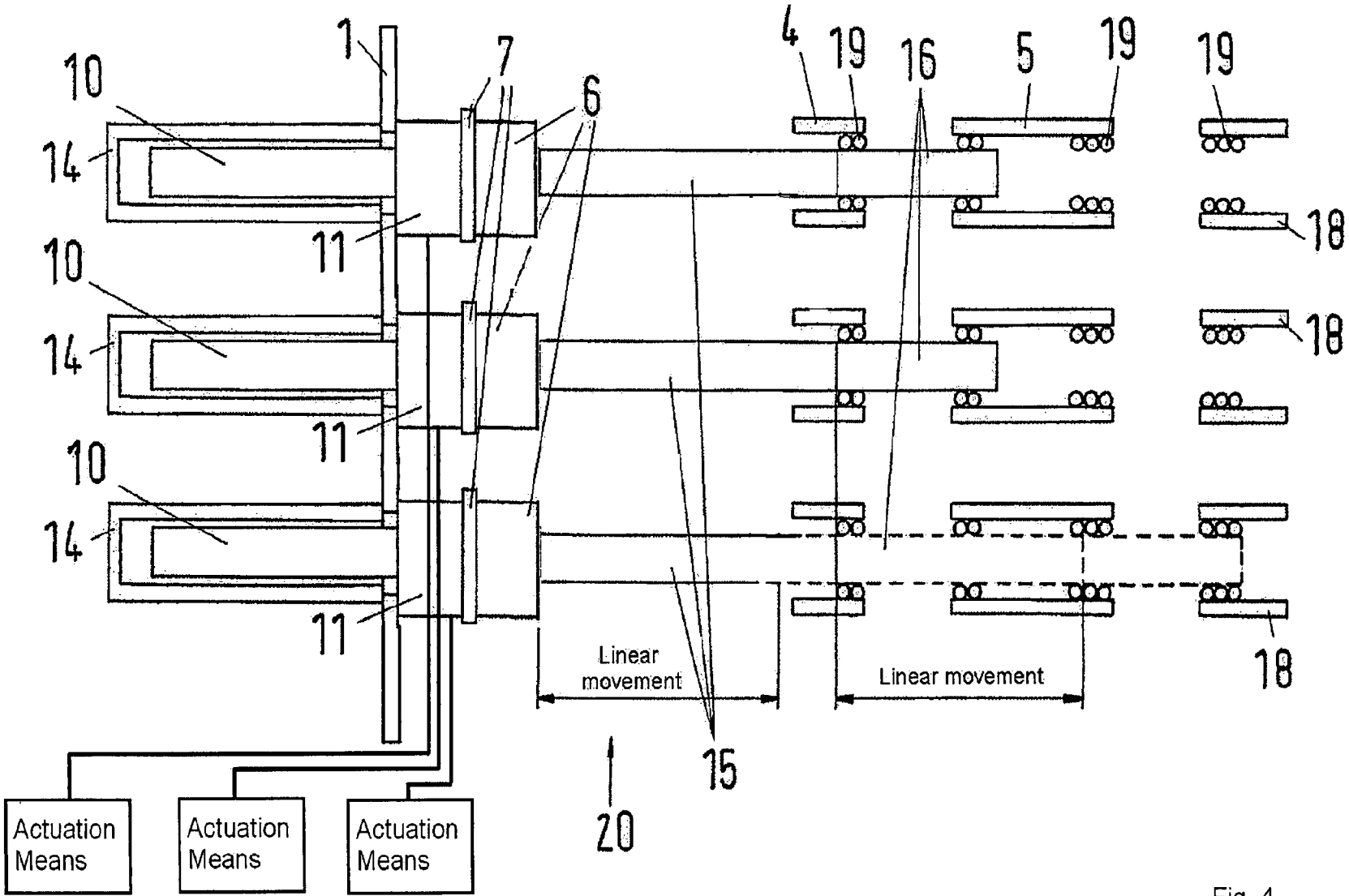
FIG. 4 shows an embodiment of a side section through the spindle drive in which each pole has a separate spindle and a separate drive.

In the exemplary embodiment described above, a single drive+a single actuation means are used for the operation of a plurality of phases (poles). Alternative, and as shown in FIG. 4, the following variants are possible:

- a separate spindle with a separate drive is provided for each phase (pole), with a single actuation means being used for operation of a plurality of phases (poles).
- a separate spindle with a separate drive is provided for each phase (pole), with a separate actuation means being used for operation of each phase (on each pole). This embodiment makes it possible to provide single-pole brief interruptions.

LIST OF REFERENCE SYMBOLS

1 Switching chamber housing
2 Busbar
3 Isolating flange
4 Grounding switch contact
5 Contact mount
6 Spindle nut housing
7 Bearing
8 Position indication
9 -
10 Spindle
11 Spindle nut
12 Linear guide
13 Connecting yoke
14 Gas-tight cover
15 Isolation rods
16 Contact pin
17 Isolating gas
18 Switch disconnector contact
19 Spiral spring contact
20 Combined switch disconnector and/or grounding switch
21 Outgoing feeder
22 Guide bolt

The invention claimed is:

1. A spindle drive for a switch disconnector and/or grounding switch, in which a spindle nut which is mounted in a spindle nut housing such as it can rotate moves a spindle translationally and during which process contact-making elements of the switching device can be moved translationally, wherein the spindle operates a contact pin, which is guided in a contact mount, via a connecting yoke, which is shared by all the phases and poles, and an isolation rod for each phase and pole.

2. The spindle drive as claimed in claim 1, wherein at least one guide bolt is arranged parallel to the spindle on the connecting yoke, and is guided in a linear guide.

3. The spindle drive as claimed in claim 2, wherein the contact-making elements are arranged in a switching chamber housing, and both the spindle and the guide bolt pass through the housing wall of the switching chamber housing.

4. The spindle drive as claimed in claim 3, wherein covers grip over the spindle and the guide bolt, with an isolating gas, which is also used within the switching chamber housing, preferably being located within the covers.

5. The spindle drive as claimed in claim 4, wherein at least one guide bolt acts on a position indication for the position of the switching device.

6. The spindle drive as claimed in claim 2, wherein the contact-making elements are arranged in a switching chamber housing, and the isolation rods pass through the housing wall of the switching chamber housing.

7. The spindle drive as claimed in claim 3, wherein the spindle nut housing is attached to the housing wall of the switching chamber housing.

8. A spindle drive for a switch disconnector and/or grounding switch, in which a spindle nut which is mounted in a spindle nut housing such as it can rotate moves a spindle translationally and during which process contact-making elements of the switching device can be moved translationally, wherein the spindle operates a contact pin, which is guided in a contact mount, each pole having a separate associated spindle with a separate drive.

9. The spindle drive as claimed in claim 8, wherein each drive has an autonomous associated actuation means.

* * * * *